United States Patent [19]

Smith

[11] 4,420,847

[45] Dec. 20, 1983

[54] HEAD WARMING PILLOW CASE

[76] Inventor: Jean E. Smith, 3305 Longbow Dr., Pittsburgh, Pa. 15235

[21] Appl. No.: 214,411

[22] Filed: Dec. 8, 1980

[51] Int. Cl.[3] ..... A47G 9/02

[52] U.S. Cl. ..... 5/490; 5/485

[58] Field of Search ..... 5/490, 485, 434–442; D6/264; 150/2.3; 112/262.1, 441

[56] References Cited

U.S. PATENT DOCUMENTS

| | | | |
|---|---|---|---|
| 1,380,480 | 6/1921 | Jennings | 5/490 |
| 2,412,769 | 12/1946 | Easterbrooks | 5/434 |
| 2,413,828 | 1/1947 | Hirsh et al. | 5/434 |
| 3,840,918 | 10/1974 | Shave | 5/434 |

*Primary Examiner*—Alexander Grosz

*Attorney, Agent, or Firm*—Parmelee, Miller, Welsh & Kratz

[57] ABSTRACT

A pillow case providing the usual slip-over cover for a conventional pillow has, over one of its rectangular areas a strip of fabric, generally a contrasting and warmer material that is stitched to one long edge of the pillow case but is of a width somewhat more than half but less than the full width of the pillow case so that the other long edge of the strip is free. The ends of the strip are attached by stitching to the two ends of the pillow case, and there are pleats in the strip clear of the smooth flat central area of the strip. Desirably the strip is cut from a continuous bolt of cloth in the form of alternately reversed trapezoids with the cloth cut diagonally to form the diverging edges of the trapezoids while the original edges of the fabric form the parallel long sides of the trapezoid. The right angle triangulated areas of the strips so formed have those edges forming the hypotenuse of the respective triangles are the end edges that are stitched to the ends of the pillow case and these areas are folded in on a bisector of the triangular areas to form a pleat at each end of the other wise flat strip. The strip thus provided may normally lie flat over the pillow case but may be opened out to form a pocket by which most of the head of the sleeper is covered for protection from cold, draughts and unwanted light.

6 Claims, 4 Drawing Figures

HEAD WARMING PILLOW CASE

This invention is for a Pillow Case or Pillow Slip used as a cover for a conventional bed pillow and particularly a pillow case which will provide warmth and comfort to the user, especially but not exclusively in cold climates.

Before the advent of central heating, it was quite usual for people of both sexes to wear some head covering at night and this was particularly true of older people. Men commonly used a "cap" of some sort and women used a head covering often referred to as a "kerchief".

With the more recent admonition for people to turn the heat down or off in sleeping quarters to save energy and the increasingly prevailing practice of sleeping where there are one or more open windows or circulating air drafts, people are again resorting to the use of some sort of head covering.

The present invention provides a pillow case or pillow cover of attractive design having as an integral part thereof a protection for the head and perhaps to a lesser degree to the back of one's neck, and, in the case of ladies, less disturbance of the "hair-do" than the individual head coverings referred to above and without the annoyance of keeping track of the extra pieces of apparel.

As will hereinafter appear my invention will enable the sleeper to exclude unwanted light, provide an attractive pillow covering when not in use, and enable contrasting color combinations to be incorporated in contrast to the flowery prints now so common.

The invention furthermore incorporates a novel and economical method of cutting and assembling the fabric in mass production to avoid waste and provide the required pleated assembly with economy in the length of fabric required.

BRIEF DESCRIPTION

I preferably begin, as is usual in making a conventional cover or pillow case with two rectangular panels of fabric which may be separate or joined along one long edge by folding a length of fabric upon itself, each panel being of an area, which after the usual stitching and hem forming to constitute an open-ended cover for receiving a conventional generally rectangular bed-pillow. From another strip or bolt of fabric, which may match the first, but which preferably is of a constrasting and warmer fabric, I cut a trapezoidal panel in which the parallel edges of the fabric strip form the parallel edges of the trapezoid while spaced oppositely directed diagonal cuts form the two divergent ends of the trapezoid. In this fashion, such trapezoidal panels with long and short parallel edges alternately reversed from side-to-side are formed with no waste of fabric except for triangular scraps at the beginning and end of the strip.

The shorter side edge of this trapezoidal section of fabric, hereinafter called a head-protecting strip or panel, is coextensive in length with the long dimension of the first two panels, and in forming the pillow case this shorter edge is stitched or seamed into a seam joining one long edge of each of said first two panels. However, the width of said strip is less than the width of the first two panels, perhaps about two thirds as wide. When so joined along its short edge into the long edge of the pillow case the head-protecting panel has a free right angle triangle at each end, the apex of which is at the point where the shorter side of the cover panel is joined into the seam along one long edge of the pillow case. The hypotenuse of each right angle triangle comprising the end areas of the trapezoidal head-protecting strip is folded under the rectangular area of said strip to a position where it meets the underlying end edge of the pillow case, as shown in the drawing, and is seamed through its entire length to said underlying edge. The other two long edges of the two first, or principal, panels are joined together in the usual way.

As thus put together the head-protecting strip forms a pocket along the length of the pillow slip, which however is not the full width of the pillow slip. The triangular end of the head-protecting strip is folded in at each end of the pillow case on a line which substantially bisects the triangular end of the head-protecting strip from the apex of each respective triangle to its base so that when the head-protecting strip folds flat against the pillow case with the end edges of the pillow case, the hypotenuse of each right angle triangle and the infold where the triangular end tucks in toward the bisector are in line with the edge of the pillow case of which they now form a part. The infolded end triangles of the head-protecting strip constitute pleated gussets that open out when the head-protecting strip is raised and thus provide room for the easy, comfortable insertion of ones head.

This invention may be more fully explained and understood by reference to the accompanying drawing in which.

Figure 1:
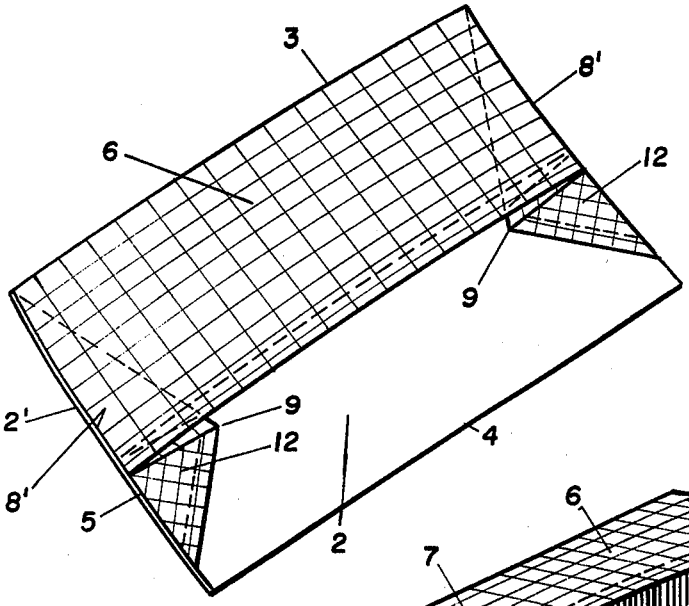
FIG. 1 is a plan view of a pillow case embodying my invention with the head-protecting panel lying flat.

It may be explained that all pieces are originally cut over size from the actual dimension of the finished product for folding into hems or seams, the seams desirably being of a type wherein the raw edges of the fabric are concealed and sometimes referred to as a French seam. In the drawings the head-protecting panel, which is usually of different fabric or weave or of a different color, or both, is cross lined (in the drawing) to distinguish it from the fabric of the body of the pillow case, the dotted lines in FIGS. 1 to 3 are fold lines, but in FIG. 4 the dotted lines indicate where successive cuts will be made in a strip of fabric to make a succession of head-protecting panels.

Figure 2:
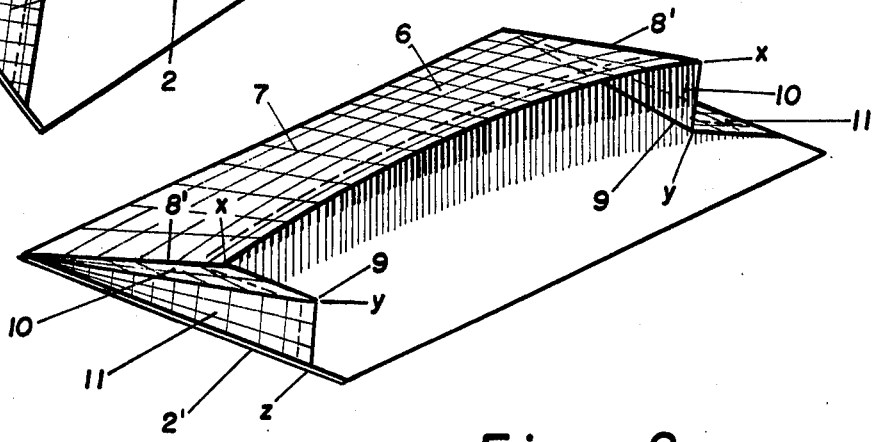
FIG. 2 is a perspective view with the head-protecting panel opened out.

Referring first to FIG. 1, the numeral 2 designates the uppermost of two similar rectangular panels comprising a conventional pillow case or cover. As is usual in the art they are joined by seams or a fold along the top and bottom edges, 3 and 4 respectively, as viewed in FIG. 1 and along the left end 5 but they are not joined across the right end and although they are each hemmed along their free edges. Since conventional rectangular bed pillows are generally used with their long axes crosswise of the bed, the long edge of the pillow nearer the head or upper end of the bed is referred to as the upper edge of the pillow and the parallel opposite edge as the lower edge, and this is likewise true of the pillow cases, and it is in this sense that these terms are used in the previous sentence and elsewhere in this specification. The edge of the lower panel is indicated by line 2' in FIGS. 1 and 2, but otherwise does not show in the drawings. The open edges at the right end provide the opening through which a conventional pillow is inserted. Frequently a slidefastener or zipper is included at this end to close it after the pillow has been placed in the case. The head-protecting panel or strip is designated generally as 6.

Figure 3:
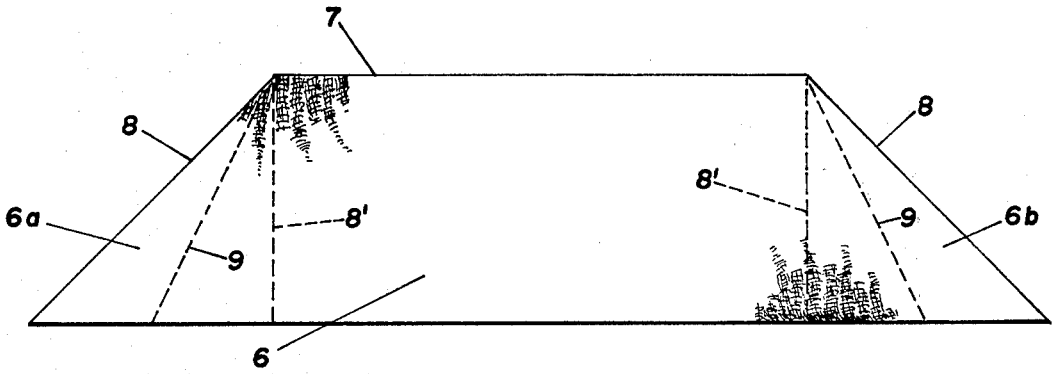
FIG. 3 is a plan view of a single head-protecting panel of trapezoidal shape.

In FIG. 3 the head-protecting panel is shown in the shape in which it is initially formed, being a trapezoid with parallel upper and lower edges as viewed in this figure, the upper edge 7 being the shorter edge and being of a length, which when incorporated in the seam joining the top edges of panel 2 and the underlying panel, is equal to (the length of) the overall length of the pillow slip of which it is a part. The width of this head-protecting panel from top to bottom is, as before stated, more than half the distance from the top edge of the pillow case to the lower edge, perhaps roughly around two-thirds as wide.

With the rectangular mid-area of the head-protecting panel being the full length of the pillow case, there is a right angle triangulation at each end of the head-protecting panel, the one at the right is designed **6*a* and at the left 6*b*. The apex of each of these triangles is at the top where the cover panel is stitched into the top edge seam of the pillow, and the base of the length of the lower edge of this p;anel, which because of the trapezoidal shape of the panel, extends beyond the length of the pillow case. The hypotenuse 8 of each of these triangles is the respective diagonal edge along which the panel is cut to form the two nonparallel or divergement, from the top down, sides of the trapezoid. The dotted 8' lines FIG. 3 form the other side or edge of the respective triangulated extensions and are fold lines, 8** of the head-protecting panel.

As most clearly seen in FIG. 2, the triangular ends of the head-protecting panel are folded inwardly, under the rectangular central area toward the transverse center of the pillow slip, and when the head-protecting panel is flat, they lie flat against the under face of the head-protecting panel, but on a second fold line 9 which substantially bisects the triangle into subtriangles 10 and 11 with the base line desirably slightly shorter from X to Y than the base line from Y to Z. As thus folded the hypotenuse 8 of the original triangular end portion of the head-protecting panel and the fold line 8' are parallel with each other and with the end edge of the pillow case but the edge comprising the hypotenuse 8 at the left of FIGS. 1 and 2 turned into the seam at the closed end of the pillow case, and the hypotenuse 8 of the triangle at the right is joined into the hem of the free edge of the pillow case which it overlies. If a zipper is used, the hypotenuse at the open end joined with the one tape of the zipper in the hem of the upper principal layer of the pillow case at the right or open end thereof.

As thus made and folded there is a pleat of upwardly tapering width and an attractive triangular extension of overlaps at 12 in FIG. 1 at each end of the head-protecting panel against the pillow case which breaks the square, straight line appearance that would otherwise result, suggesting somewhat the draped sides of a stage procenium, and when the head-protecting panel is opened out, this shapes the free edge of said panel into a slight arch. Not only does the tapering pleat so formed at each end of the head-protecting strip provide a unique appearance, but it also provides a decreasing freedom in the distance the head-protecting strip will separate from the surface of the pillow case, so that the air space under the head-protecting panel when the pillow is in use diminishes toward the upper edge of the head-covering pocket and hence provides a more intimate and cozy effect but reduces the air space to be warmed by heat from the sleeper's head.

Figure 4:
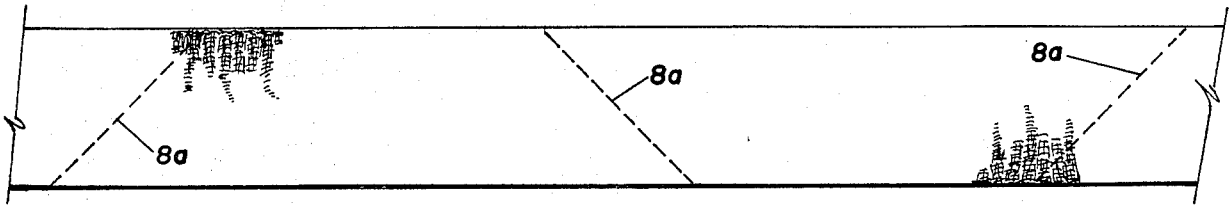
FIG. 4 is a view showing a strip of fabric with diagonal dotted lines indicating successive cuts to be made in the fabric to form the trapezoidal panels.

FIG. 4 discloses a length of fabric, or a portion of a length as unrolled from a bolt of many yards. The fabric is of uniform width, the overall width of the head-protecting panel 6, but as here shown is on a smaller scale. The reversed diagonal dotted lines in this figure, marked **8*a***, indicate the lines along which the fabric will be cut to form individual trapezoidal pieces, each of the head-protecting panel size and shape but with the alternate trapezoids reversed, edge for edge, so that if the first piece in the strip has the short edge along the top of the strip, as viewed in the drawing, the next one will have the short edge at the bottom, and the next again at the top, etc. In this way there is no waste of fabric except for a triangle at the beginning and another at the end cut of the strip.

The pillow case may be laundered as a unit with its attached head-protecting strip and if one does not wish to use the head-protecting panel or have it show, he has merely to turn the pillow over. With one long edge of the head-protecting panel and the two end edges being stitched into the seams or end hems of the fabric of the pillow case but with pleats or folds at or near the ends it can lie flat against the pillow case but when it is opened out there are not folds or seams at the middle area of the pillow where they might annoy or interfere with the comfort coiffure of the sleeper. By having the pleats in the form of gussets closing the ends of the pocket, they are especially positioned to avoid any interference with the face of the user, and with his head at one end or the other of the pocket, the gusset will provide protection from annoying or discomforting drafts as well as for the back of the neck of the sleeper.

The tapered pleat at each end of the pillow and head protector, being widest at the free lower edge of the assembly, not only provides a pocket with an expansible closure at each end but it forms a pocket which becomes increasingly shallower along its upper edge in such manner as to diminish the air space in the pocket which is required to be warmed by heat from the user's head, but which at the same time does not draw tightly over the user's head or face, contributing not only to an air space that quickly reaches a comfortable temperature, even in a quite cold room, but which gives a feeling of freedom that cannot be achieved where the edges of the head-protecting strip are straight instead of angular and are stitched directly to the ends of the pillow case.

In warm weather and warmer climates sleepers exposed to drafts from air conditioners will find comfort in the protection afforded with the use of the pillow slip herein disclosed.

I claim

1. A pillow case comprising two overlying rectangular panels joined together along both the two long edges and across one end only with their other edges unattached and free of each other thus forming an envelope-like cover to receive a pillow through the open end, a trapezoidal strip more than half as wide but less than the full width of the panels from one long edge to the other, the trapezoid having a rectangular central area with parallel lengthwise edges and end edges of equal length diverting from the shorter edge of the trapezoid to the longer whereby there are opposite equal right angle triangular end areas, one at each end of the rectangular central area of the strip, the shorter of the parallel edges of the trapezoid being stitched along one long edge of the pillowreceiving envelope, one diagonal end edge of said trapezoidal strip being stitched along the closed end of the envelope and the other diagonal edge of the strip being stitched to the other edge of the underlying rectangular panel, the long edge of the rectangular central area of the trapezoidal strip being loose and unattached to the envelope-like cover, the triangular end areas of each end of the trapezoidal strip being folded into a reversely folded pleat under the central area of the overlying rectangular area of the trapezoidal strip, with the end edges of the rectangular area of said strip being even with corresponding ends of the envelope-like cover.

2. A combined pillow case and head covering comprising a rectangular fabric envelope with an opening through which a rectangular pillow may be inserted into the envelope, a panel of trapezoidal shape with parallel long and short edges, the shorter of which is of a length substantially coextensive with one long edge of the envelope and is attached to one long edge of the envelope, the panel having its said long edge generally parallel with the short edge but unattached to the long edge of the envelope, the two ends of the trapezoid each comprising a right angle triangle, the hypotenuse of the respective triangular ends being attached to the underlying end of the envelope and one side edge of the right angle triangle forming part of the long side of the trapezoid, with the area of each triangular end being folded inwardly to form a pleat, the confronting faces of which are matching triangles with the apex at the end of said shorter side of the trapezoid.

3. The pillow case and head protector defined in claim 2 in which the trapezoid panel comprises an integral section of strip fabric of the width of the trapezoid with the long and short edges comprising finished edges of the fabric strip.

4. A combination pillow cover and head-protecting panel wherein the pillow cover has parallel upper and lower edges that extend crosswise of the length of the bed for which it is designed to be used and generally parallel end edges, and the head-protecting panel comprises a fabric strip of trapezoidal shape, the trapezoid having a flat rectangular area of the same length as the upper and lower edges of the pillow cover but of a width less than the full width of the pillow cover from the top to the bottom edge, the head-protecting panel having a right angle triangle at each end, the apex of each triangle being at the upper corner of the head-protecting panel rectangular area and the base of each triangle comprising a straight line extension of the lower edge of the head-protecting panel whereby the lower edge is longer than its upper edge; the upper edge of the rectangular area of the strip being seamed to the upper edge of the pillow cover and the hypotenuse of each triangle is stitched to the underlying respective ends of the pillow cover with the triangles being folded inwardly toward the middle of the pillow cover to form an inwardly turned pleat comprised of two confronting triangles having a common apex coinciding with the apex of the original triangular areas of the trapezoid and with the base margins of said confronting triangles forming a zigzag extension at the ends of the pillow cover extending from the lower corner of the rectangular area of the strip below its lower edge toward the lower edge of the pillow cover.

5. The combination of claim 4 wherein the pillow cover is a pillow case.

6. The method of making a pillow cover having upper and lower edges and parallel ends substantially perpendicular to said edges into a head-warming pillow case, comprising:

(a) cutting from a strip of fabric of a width less than the full width of the pillow cover between its upper and lower edges but greater than half said width and of the order of two-thirds such full width a trapezoidal head protecting panel having oppositely formed right angle triangular area between which is a center area of a size and shape coextensive with the area of the pillow cover, the strip so formed thereby having a shorter edge between the apexes of the right angle triangles and a longer edge comprising the length of the center area plus the base of the two triangles, the hypotenuse of each triangle being of the same length and an overall length greater than the width of the strip of which they are formed;

(b) seaming with a closed seam the upper edge of the matching central area of the trapezoidal strip to the upper edge of the pillow cover and folding the right angle triangular ends of the strip inwardly under the center area with the hypotenuse of each triangular end of the strip being parallel with the underlying side edges of the pillow cover and seaming the hypotenuse when so folded to the underlying ends of the pillow cover and with the fold line forming a common boundary between two confronting but oppositely turned smaller triangles into which each original right angle triangle is formed, the base areas of said oppositely turned triangles crossing each other to form a unique zigzag pattern at each end of the combined pillow cover and head-protecting strip.

* * * * *